US007472671B2

(12) United States Patent
Elendt et al.

(10) Patent No.: US 7,472,671 B2
(45) Date of Patent: Jan. 6, 2009

(54) VALVE ENGINE

(75) Inventors: Harald Elendt, Altendorf (DE); Christof Faria, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 41 days.

(21) Appl. No.: 11/632,558

(22) PCT Filed: Jul. 2, 2005

(86) PCT No.: PCT/EP2005/007148

§ 371 (c)(1),
(2), (4) Date: Jan. 16, 2007

(87) PCT Pub. No.: WO2006/012959

PCT Pub. Date: Feb. 9, 2006

(65) Prior Publication Data

US 2007/0204819 A1 Sep. 6, 2007

(30) Foreign Application Priority Data

Jul. 30, 2004 (DE) ..... 10 2004 037 198

(51) Int. Cl.
*F01L 1/04* (2006.01)

(52) U.S. Cl. ..... 123/90.6; 123/90.16; 123/90.31

(58) Field of Classification Search ..... 123/90.16, 123/90.2, 90.27, 90.31, 90.6
See application file for complete search history.

(56) References Cited

FOREIGN PATENT DOCUMENTS

| | | | |
|---|---|---|---|
| DE | 73 30 201 | U | 8/1974 |
| DE | 3401 057 | A1 | 7/1984 |
| DE | 196 11 641 | C1 | 3/1996 |
| DE | 197 02 389 | A1 | 7/1998 |
| DE | 101 48 177 | A1 | 4/2003 |
| DE | 101 48 178 | A1 | 4/2003 |
| DE | 101 48 179 | A1 | 4/2003 |
| DE | 101 48 243 | A1 | 4/2003 |
| DE | 197 02 389 | B4 | 5/2004 |
| EP | 0 798 451 | A1 | 10/1997 |
| JP | 02 016312 | A | 1/1990 |
| WO | WO 95/35434 | | 12/1995 |

*Primary Examiner*—Ching Chang
(74) *Attorney, Agent, or Firm*—Charles A. Muserlian

(57) ABSTRACT

A valve drive for an internal combustion engine having at least one camshaft which has a toothed shaft (2) and at least one cam part (3) with a plurality of different cam paths (13, 14) arranged adjacent to one another for the variable actuation of gas exchange valves (8) by displacement of the cam parts (3) by means of actuators (actuator pins 4 and 5) on the toothed shaft (2), the toothed shaft (2) having a shaft profile (9) and the cam parts (3) having a hub profile (10) which is matched to said shaft profile (9), and the number of wedges, notches or teeth (19) of the shaft profile (9) and of the hub profile (10) being such that the different cam positions for four-stroke internal combustion engines of any type such as in-line engines, V-engines or W-engines, and with any numbers of cylinders, can be provided with the same toothed shafts (2) and cam parts (3).

2 Claims, 2 Drawing Sheets

VALVE ENGINE

This application is a 371 of PCT/EP2005/007148 filed Jul. 2, 2005.

FIELD OF THE INVENTION

Valve drive for an internal combustion engine having at least one camshaft which has a toothed shaft and at least one cam part with a plurality of different cam paths arranged adjacent to one another for the variable actuation of gas exchange valves by displacement of the cam parts by means of actuators on the toothed shaft, the toothed shaft having a shaft profile and the cam parts having a hub profile which is matched to said shaft profile.

BACKGROUND OF THE INVENTION

Such a valve drive of an internal combustion engine is known from DE 196 11 641 C1. The displacement of the cam parts on the toothed shaft of the camshaft is made possible by a shaft profile and a hub profile. Since four-stroke reciprocating piston internal combustion engines have defined ignition sequences for a given number of cylinders, the cams must be arranged at a specific angle relative to one another on the camshaft. In a four-cylinder reciprocating piston internal combustion engine with uniform ignition intervals, the relative rotational angle of the inlet valve cams with respect to one another and of the outlet valve cams with respect to one another is in each case 90°. It is of course straightforward to produce a corresponding camshaft.

Object of the Invention

It is an object of the invention to produce a generic valve drive for an internal combustion engine, by means of which it is possible to utilize the same toothed shaft and the same cam parts for the inlet and/or the outlet cam shafts of a plurality of engine versions, since a uniform profiling results in low tooling costs and identical blanks for the toothed shaft and for the cam parts.

SUMMARY OF THE INVENTION

The object of the invention is achieved in that the number of wedges, notches or teeth of the shaft profile and of the hub profile is such that the different cam positions of four-stroke internal combustion engines of any type such as in-line engines, V-engines or W-engines, and with any numbers of cylinders, can be provided with the same toothed shafts and cam parts.

In referring to wedges, notches or teeth with regard to the shaft and hub profiles, it is to be noted that there are various standardized shaft and hub profiles which are all to be encompassed by the present invention. If one and the same profile and therefore one and the same toothed shaft and one and the same base cam part are to be used for very different angles, it is necessary to be capable of providing different angular positions.

The intervals both of the inlet cams relative to one another and of the outlet cams relative to one another is in each case 120° in a three-cylinder in-line engine with uniform ignition intervals, 90° in a four-cylinder in-line engine, 60° in a six-cylinder in-line engine and also in a six-cylinder V-engine with uniform ignition intervals, 45° in an eight-cylinder V-engine and 30° in a twelve-cylinder V-engine. These angular intervals apply to the entire engine, and consequently only when use is made of one inlet valve camshaft and one outlet valve camshaft, or one common uniform camshaft for the inlet and outlet valves, per engine. If, in the case of a V-engine, at least one separate camshaft is used per cylinder row or cylinder bank, the ignition sequence of the engine is also taken into consideration. If the ignition sequence alternates from one cylinder row to the other, then the angular interval of the inlet cams and outlet cams on the one or more camshafts of one cylinder row is doubled. However, since further engines, specifically in-line engines, V-engines and W-engines can be used with up to twenty cylinders, all the intervals of the cams relative to one another should be defined by the suitable number of wedges, notches or teeth.

In one preferred embodiment of the invention, it is proposed that for in-line engines with three, four and six cylinders and additionally for V-engines with uniform ignition intervals with six cylinders and for eight-cylinder and twelve-cylinder V-engines, the number of wedges, notches or teeth is preferably 24 or a multiple of 24. This is obtained in that the angular interval between a six-cylinder engine and an eight-cylinder engine and between an eight-cylinder engine and a twelve-cylinder engine is in each case 15° between two inlet cams and two outlet cams, so that it must be possible to obtain 15° intervals in one rotation of the camshaft through 360°, resulting in a number of 24 teeth. If, as already stated above, one camshaft or one inlet camshaft and one outlet camshaft are used per cylinder row, it is possible for the number of teeth to be reduced.

It is also proposed that, if a five-cylinder in-line engine and a ten-cylinder V-engine are also to be considered, the number of wedges, notches or teeth is preferably 120 or a multiple of 120. This is obtained in that, when considering said motors, relative rotational positions of the cam parts with respect to one another of 6° and 9° must also be possible, resulting in a common denominator of 3° and therefore 120 teeth, if again one single camshaft or one inlet camshaft and one outlet camshaft are used per motor. Where separate camshafts are used for each cylinder row, the number of teeth is in turn reduced if appropriate.

It should be explicitly pointed out that other different engines such as W-engines or, also V-engines of up to 20 cylinders can and should be described. Here, the diameter of the toothed shaft and of the cam parts can by all means be kept within limits since, in addition to the claimed shaft profiles, there are also fine profiles, by means of which it is possible to define small relative rotational angles at justifiable diameters, especially since it is conventional in said engines to use a plurality of camshafts.

BRIEF DESCRIPTION OF THE DRAWINGS

In order to further explain the invention, reference is made to the drawings, in which an exemplary embodiment of the invention is illustrated in a simplified fashion. In the drawings.

DETAILED DESCRIPTION OF THE DRAWINGS

Figure 1:
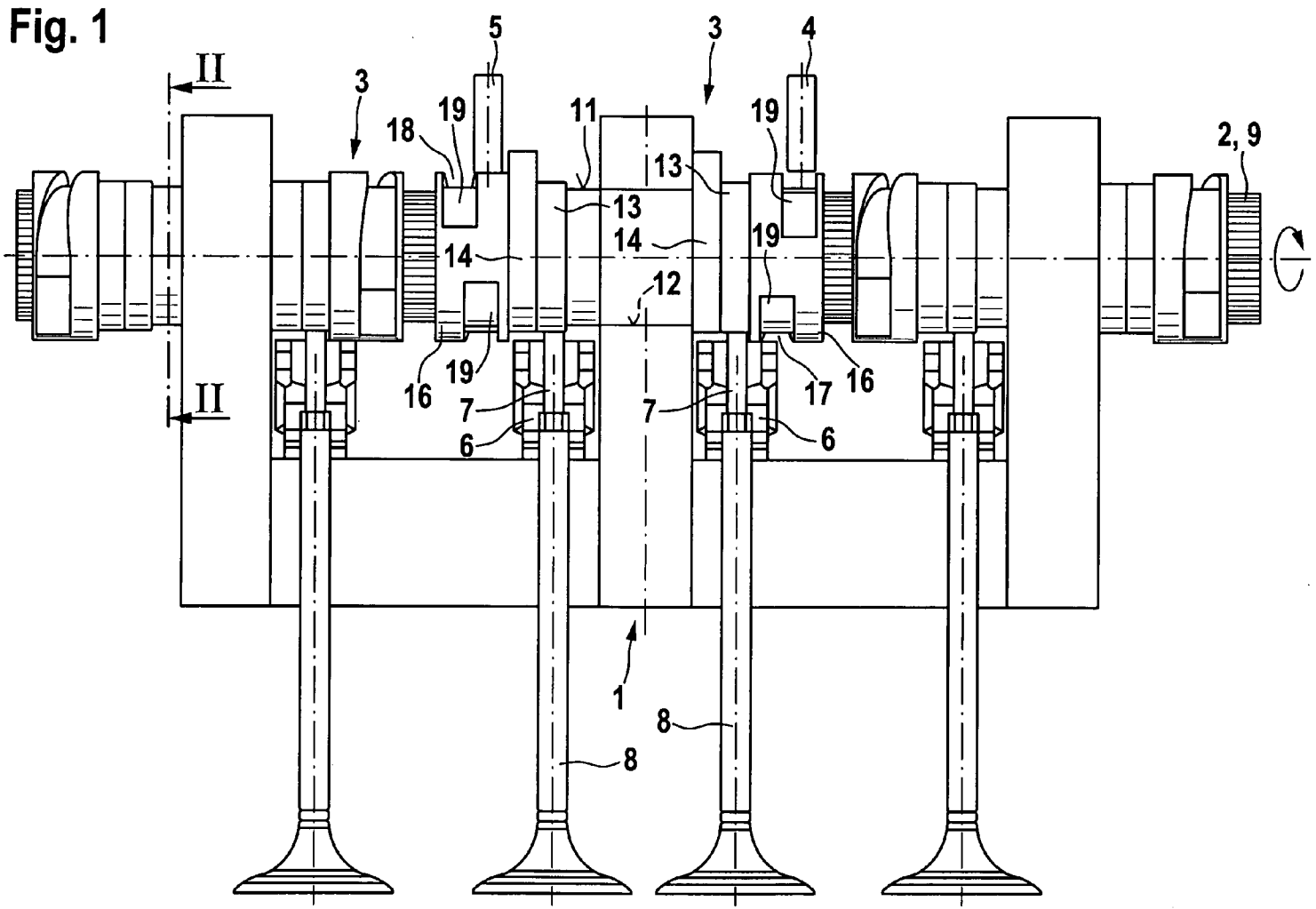
FIG. 1 shows a side view of a camshaft with gas exchange valves.
Figure 2:
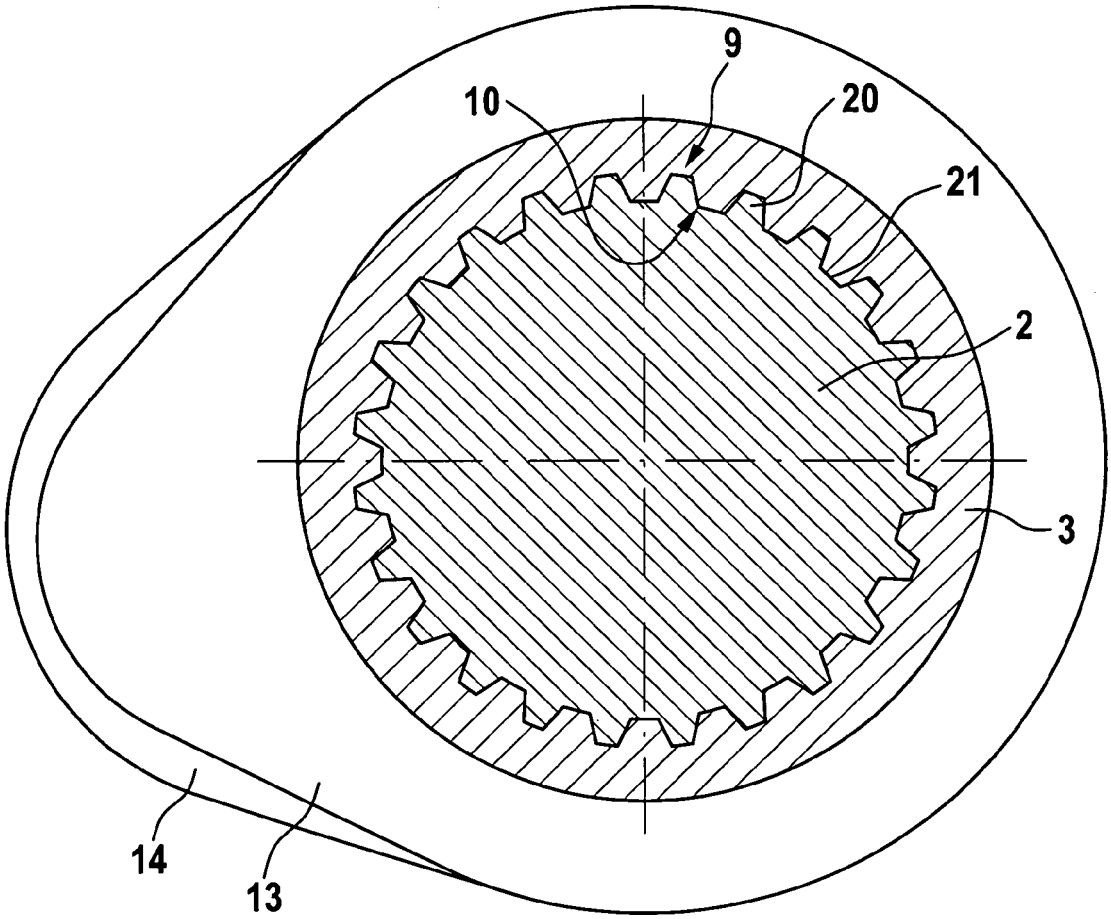
FIG. 2 shows a section through the camshaft with the toothed shaft and cam part as per line II-II in FIG. 1.

FIGS. 1 and 2 illustrate, in detail where appropriate, and denoted by 1, a cylinder of a reciprocating piston internal combustion engine with parts of a valve drive. The parts include inter alia a toothed shaft 2 with cam parts 3, two actuator pins 4 and 5, transmitting elements 6 and 7 between the cam parts and gas exchange valves denoted by 8. The gas exchange valves 8 can be embodied as inlet valves or outlet valves.

The toothed shaft 2 has a shaft profile 9 at least on sections of its longitudinal extent. The cam parts 3 are provided with a hub profile 10 which matches said shaft profile 9 and by means of which said cam parts are arranged on the toothed shaft 2 so as to be rotationally fixed but axially displaceable.

The cam parts 3 have, on their outer periphery, in each case one bearing point 11 which serves to support the cam part 3 and therefore the toothed shaft 2. The bearing points 11 are assigned bearings 12 which are fastened (not illustrated) to a cylinder head. The bearing points 11 of the cam parts 3 are adjoined at both sides by cam paths 13 and 14. The cam paths 13 and 14 have different cam lift dimensions but the same base circle diameter. The latter is significant in ensuring that there is no jamming between the transmitting elements 6 and 7 and the cam paths 13 and 14 during the displacement of the cam parts 3. The cam paths 13 and 14 are adjoined by cylindrical sections 16 with which the cam parts 3 end. The cylindrical sections 16 have in each case one displacement groove 17 and 18 for each displacement direction. Said displacement grooves 17 and 18 are preferably designed and arranged mirror-symmetrically with respect to one another, so that the gradients of the two displacement grooves 17 and 18 are oppositely aligned. Said displacement grooves 17 and 18 have a gradient which corresponds, in one rotation of the cam parts 3, to the displacement dimension of the latter.

The displacement grooves 17 and 18 run out on the periphery of the cylindrical sections 16 via end pieces 19 which are offset relative to one another at an interval.

The actuator pins 4, 5 are mounted in actuator housings (not illustrated). They are inserted alternately into the displacement grooves 17 and 18. The axial displacement of the cam parts is provided in this way.

As can be seen in particular from FIG. 2, the shaft profile 9 is designed as a toothed hub profile with teeth 20 and recesses 21, to which corresponding internal teeth and internal recesses of the hub profile 10, which is formed as a toothed hub profile, of the cam parts 3 is matched.

The desired relative rotational angle of the cam parts 3 with respect to one another can be obtained on one and the same toothed shaft 2 by means of a suitable selection of the teeth of the toothed hub profile and of the toothed shaft profile, so that a large number of engines having one and the same toothed shaft and the same base cam parts can be obtained using a tooth quantity of 24 or a multiple of 24. If five-cylinder in-line engines and ten-cylinder V-engines are also included in order to cover the range of conventional vehicle engines, then 120 teeth or a multiple thereof per toothed shaft profile and toothed hub profile can preferably also be favorable in order to obtain the desired relative rotational angle.

List of Reference Symbols

1 Cylinder
2 Toothed shaft
3 Cam parts
4 Actuator pin
5 Actuator pin
6 Transmitting element
7 Transmitting element
8 Gas exchange valves
9 Shaft profile
10 Hub profile
11 Bearing point
12 Bearing
13 Cam path
14 Cam path
16 Cylindrical section
17 Displacement groove
18 Displacement groove
19 End piece
20 Teeth
21 Recesses

The invention claimed is:

1. A valve drive for an internal combustion engine having at least one camshaft which has a toothed shaft and at least one cam part with a plurality of different cam paths arranged adjacent to one another for the variable actuation of gas exchange valves by displacement of the cam parts by means of actuators (actuator pins) on the toothed shaft, the toothed shaft having a shaft profile and the cam parts having a hub profile which is matched to said shaft profile wherein the number of wedges, notches or teeth of the shaft profile and of the hub profile is 24 or a multiple of 24 such that the different cam positions of four-stroke internal combustion engines in the version of in-line engines with three, four and six cylinders and V6 engines with uniform ignition intervals and eight-cylinder and twelve cylinder V-engines can be provided with the same toothed shafts and cam parts.

2. A valve drive for an internal combustion engine of claim 1, wherein for five-cylinder in-line engines and ten-cylinder V-engines which are also provided with uniform toothed shafts and cam parts, the number of wedges, notches or teeth is 120 or a multiple of 120.

* * * * *